US005638342A

United States Patent [19]

Kartsotis et al.

[11] Patent Number: 5,638,342

[45] Date of Patent: Jun. 10, 1997

[54] WATCH SADDLE

[75] Inventors: Tom Kartsotis, Dallas; Suzanne M. Amundsen, McKinney; Timothy G. Hale, Garland, all of Tex.; Hiroshi Nakahara, Chiba, Japan

[73] Assignee: Fossil, Inc., Richardson, Tex.

[21] Appl. No.: 499,480

[22] Filed: Jul. 7, 1995

[51] Int. Cl.[6] ..... G04B 37/00; A44C 5/00

[52] U.S. Cl. ..... 368/282; 368/286; 224/171

[58] Field of Search ..... 368/276, 281–283, 368/286, 305, 310; 224/171, 164

[56] References Cited

U.S. PATENT DOCUMENTS

| | | | |
|---|---|---|---|
| D. 50,558 | 4/1917 | Levi . | |
| D. 51,225 | 9/1917 | Dean . | |
| 1,313,798 | 8/1919 | Devine . | |
| 2,184,060 | 12/1939 | Singer . | |
| 2,328,785 | 9/1943 | Cozart | 368/281 |
| 2,342,804 | 2/1944 | Hiller | 324/171 |
| 2,546,859 | 3/1951 | Innes | 368/286 |
| 2,595,330 | 5/1952 | Brown | 368/286 |
| 2,601,943 | 7/1952 | Pachter | 368/286 |
| 3,194,004 | 7/1965 | Church | 368/281 |
| 3,712,049 | 1/1973 | Luxembourg | 368/286 |

FOREIGN PATENT DOCUMENTS

| | | | |
|---|---|---|---|
| 811088 | 4/1937 | France | 368/286 |
| 110048 | 10/1917 | United Kingdom | 368/286 |

*Primary Examiner*—Vit W. Miska

*Attorney, Agent, or Firm*—Randall C. Brown; James F. Struthers; Locke Purnell Rain Harrell

[57] ABSTRACT

A watch saddle for providing ventilation and spacing between a user's wrist and a wristwatch.

17 Claims, 1 Drawing Sheet

WATCH SADDLE

BACKGROUND OF THE INVENTION

1. Field of the Invention

The present invention relates to a watch saddle. The watch saddle has particular utility in connection with providing ventilation and spacing between a user's wrist and a wristwatch.

2. Description of Related Information

A wristwatch typically comprises a roughly circular body having a face, a crystal, a crown, and a backplate. A digital watch may comprise one or more buttons rather than a crown. The wristwatch body is typically held in place on the wrist by a strap and buckle combination (or a continuous band) that is attached to the edges of the watch body that correspond to the twelve o'clock and six o'clock edges of the face. The face of the watch is directed away from the user's wrist when the watch is worn.

In the past, the backplate of a watch typically rested against the user's wrist. This constant contact with the user's wrist was responsible in the past for inducing heat retention, friction, and sweat under the backplate. Besides causing some discomfort to the user, sweat can have an unpleasant odor and can attract dirt to the watch. The moisture may also rust the backplate or the watch mechanism. It is desirable therefore to provide ventilation and spacing means between a user's wrist and a watch body so as to both reduce sweating and to reduce the likelihood that sweat will come into contact with the backplate.

In addition to inducing sweat, wristwatches that lay flat against the wrist may impede access to the crown or control buttons, and may impede full wrist motion. In addition, where a wristwatch is flat against the wrist, the hardware connecting the body to the strap is immediately adjacent to the wrist and can trap wrist hair. It is desirable therefore to provide spacing means between the wrist and the watch body.

Wristwatches today are as much a fashion accessory as a time-telling means, and as a result, cumbersome or unattractive ventilation or spacing means would be a great disadvantage. Thus, any mechanism employed for the aforementioned purposes would preferably complement the overall appearance of the watch.

Any mechanism employed for the aforementioned purposes should be flexible to allow a secure fit with a variety of watches. The mechanism should also have sufficient contact area with a user's wrist so as not to concentrate forces into a small area thereof. Because the user may wish to remove the mechanism, after playing a sport for example, the mechanism should be easy to install and remove. Consequently, a mechanism permanently affixed to the watch by cement, rivets or the like would be undesirable. Finally, the mechanism should enjoy the advantages of a one-piece design.

A need exists, therefore, for a one-piece watch saddle, for ventilating and spacing the body of a wristwatch, that features economy and simplicity of design, that will accommodate a variety of watches, that is easy to install and remove, that is quiet and secure when installed, and whose appearance does not detract from the overall appearance of the watch.

SUMMARY OF THE INVENTION

The apparatus of the present invention overcomes the above-mentioned disadvantages and drawbacks which are characteristic of the related information. The apparatus of the present invention comprises a resilient, rubber watch saddle.

In a preferred embodiment, the watch saddle of the present invention comprises a perforated disc having a wrist side, and a watch side against which the backplate of a watch may rest. The disc perforations are preferably circular.

Integral handles, each having an orifice through which a watch strap may pass, protrude upwardly from the twelve and six o'clock positions of the watch side of the disc. In a preferred embodiment, the handles are adapted to be elastically stretched over a watch strap or over the periphery of the watch body.

In a preferred embodiment, a series of discrete spacing projections extends from the wrist side of the disc in an annular pattern which surrounds the disc perforations. The spacing projections are preferably curved to roughly match the curvature of the outside of the disc.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings.

DESCRIPTION OF THE PREFERRED EMBODIMENTS

Figure 1:
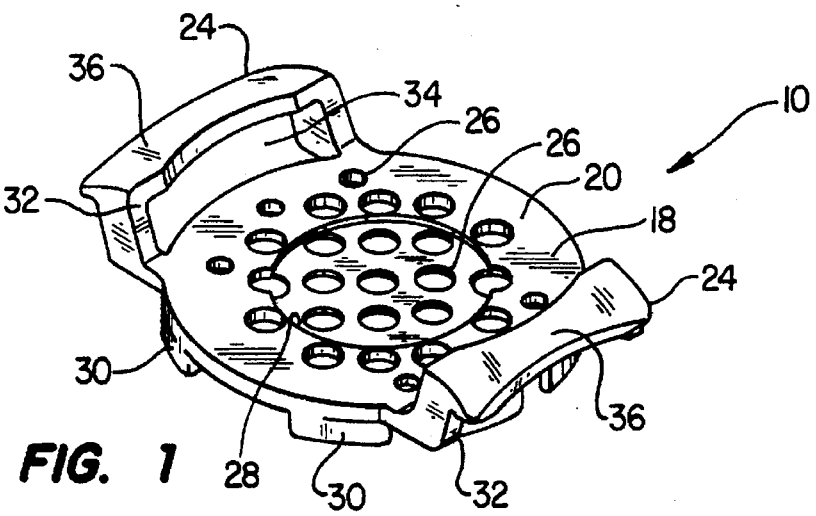
FIG. 1 is a perspective view of the watch saddle of the present invention, taken from the watch side of the saddle.

Referring now to the drawings, a preferred embodiment of the watch saddle of the present invention is shown and generally designated by the reference numeral 10. In a preferred embodiment, the watch saddle 10 is made of a flexible, elastic material such as rubber. However, those of ordinary skill in the art will recognize that the saddle 10 may be made of other materials.

Figure 3:
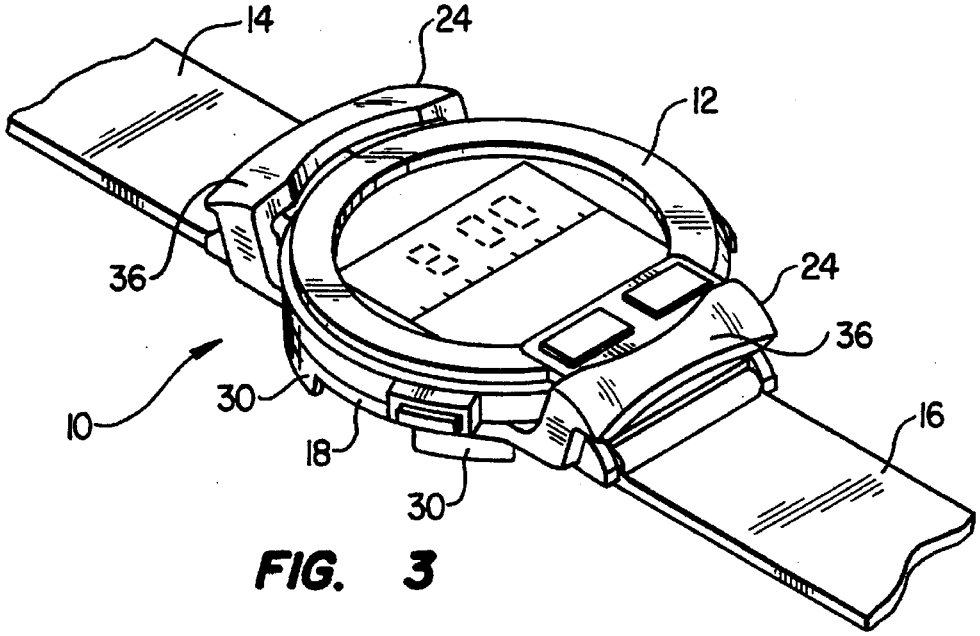
FIG. 3 is a perspective view of the watch saddle of the present invention, shown with a wristwatch installed therein.

Referring now to FIG. 3, the watch saddle 10 is used in connection with a wristwatch 12. Customarily, a top strap element 14 extends from the twelve o'clock position on the wristwatch 12 and a bottom strap element 16 extends from the six o'clock position on the wristwatch 12 (or from the equivalent locations of a digital watch). Those of ordinary skill in the art will recognize that the top strap element 14 and bottom strap element 16 may extend from any two diametrically opposed positions on the wristwatch 12.

Figure 2:
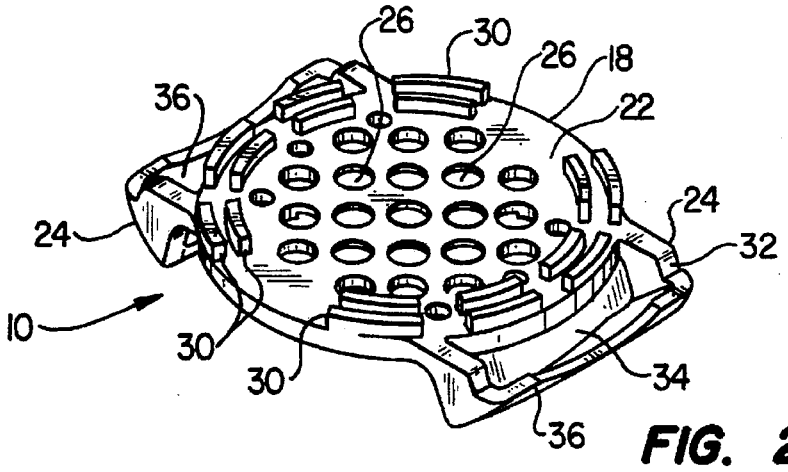
FIG. 2 is a perspective view of the watch saddle of the present invention, taken from the wrist side of the saddle.

Referring now to FIGS. 1 and 2, the watch saddle 10 comprises a roughly circular disc 18 having a watch side 20 and a wrist side 22. Handles 24 protrude upwardly from diametrically opposed edges of the watch side 20 of the disc 18. The locations of the handles 24 correspond to the six o'clock and twelve o'clock positions of a wristwatch 12.

Axially parallel ventilation holes 26 extend between the watch side 20 and the wrist side 22 of the disc, and are distributed across the disc 18. In a preferred embodiment, an inner portion 28 of the watch side 20 of the disc 18 is slightly recessed to provide greater air circulation past the backplate (not shown) of the watch 12.

Spacing projections 30 protrude from the wrist side 22 of the disc 18, and are distributed in an annular pattern surrounding the ventilation holes 26. In a preferred embodiment, the spacing projections 30 are distributed in two roughly concentric paths at the edge of the disc 18.

Those of ordinary skill in the art will recognize that the arrangement of the ventilation holes 26 and spacing projections 30 may be varied without departing from the spirit and scope of the present invention.

In a preferred embodiment, each handle 24 comprises an upwardly protruding flexible and elastic loop 32 surrounding an orifice 34 suitable for receiving the top strap element 14 or bottom strap element 16 of a wristwatch 12. In a preferred embodiment, the top of each loop 32 comprises a widened portion 36 which may be elastically stretched around the strap or the periphery of the wristwatch 12 for a secure fit. Those of ordinary skill in the art will recognize that the loops 32 may be custom designed for a particular watch body or may be used with varying watch bodies depending on the elastic range of the handle material.

In operation of the watch saddle 10 of the present invention, the top strap element 14 of the watch 12 is inserted through one handle orifice 34, and the bottom strap element 16 is inserted through the other handle orifice 34. The strap elements 14, 16 are urged further into the respective handle orifices 34 until the backplate (not shown) of the watch 12 lies flat against the watch side 20 of the disc 18. The widened portion 36 of each loop 32 may be elastically stretched to hook the periphery of the watch 12. The watch saddle 10 may be removed by reversing the process.

Those of ordinary skill in the art will recognize that the watch saddle 10 may also be used in connection with a continuous band by installing the watch saddle 10 before the band is affixed to the watch 12.

While preferred embodiments of the invention have been shown and described, it will be understood by those of ordinary skill in the art that various changes and modifications may be made without departing from the spirit and scope of the invention which is defined by the following claims.

What is claimed is:

1. A watch saddle for use in connection with a watch, wherein said watch comprises a first edge, a second edge, and means extending from said first edge and said second edge for securing said watch to a user's wrist, wherein said watch saddle comprises:

a) a body having a first side and a second side; and b) first and second handles extending from diametrically opposed edges of said body, wherein said first handle defines an orifice adapted to receive said wrist-securing means at said first edge of said watch, and wherein said second handle defines an orifice adapted to receive said wrist-securing means at said second edge of said watch.

2. A watch saddle according to claim 1 wherein said first and second handles of said watch saddle are flexible.

3. A watch saddle according to claim 1 wherein said first and second handles of said watch saddle are elastically deformable.

4. A watch saddle according to claim 1 wherein said watch saddle comprises a rubber material.

5. A watch saddle according to claim 1 wherein each said first and second handle comprises first and second leg portions extending perpendicular to said wrist-securing means and a connecting portion extending between and connected to said first and second leg portions.

6. A watch saddle according to claim 5 wherein said connecting portion has a greater width that the width of each said first and second leg portions.

7. A watch saddle according to claim 1 wherein said body comprises a disc.

8. A watch saddle according to claim 1 wherein said body is perforated by at least one ventilation hole.

9. A watch saddle according to claim 8 wherein a spacing projection protrudes from said first side of said body.

10. A watch saddle according to claim 8 wherein a plurality of discrete spacing projections protrude from said first side of said body.

11. A watch saddle according to claim 10 wherein said plurality of spacing projections are distributed in an annular pattern surrounding said at least one ventilation hole.

12. A watch saddle according to claim 10 wherein said plurality of spacing projections are distributed in two concentric paths roughly corresponding to the perimeter of said disc and surrounding said at least one ventilation hole.

13. A watch saddle according to claim 1 wherein said body is perforated by a plurality of ventilation holes and wherein said second side of said body comprises a recessed portion over at least two of said ventilation holes.

14. A watch saddle according to claim 13 wherein a spacing projection protrudes from said first side of said body.

15. A watch saddle according to claim 13 wherein a plurality of discrete spacing projections protrude from said first side of said body.

16. A watch saddle according to claim 15 wherein said plurality of spacing projections are distributed in an annular pattern surrounding said plurality of ventilation holes.

17. A watch saddle according to claim 13 wherein said plurality of spacing projections are distributed in two concentric paths roughly corresponding to the perimeter of said disc and surrounding said plurality of ventilation holes.

* * * * *